US008777816B2

(12) United States Patent
Grafman et al.

(10) Patent No.: US 8,777,816 B2
(45) Date of Patent: Jul. 15, 2014

(54) BAR GRIP

(76) Inventors: Lonny Grafman, Mckinleyville, CA (US); Gabriel Krause, Brooklyn, NY (US)

( * ) Notice: Subject to any disclaimer, the term of this patent is extended or adjusted under 35 U.S.C. 154(b) by 341 days.

(21) Appl. No.: 13/089,453

(22) Filed: Apr. 19, 2011

(65) Prior Publication Data

US 2011/0256992 A1 Oct. 20, 2011

Related U.S. Application Data

(60) Provisional application No. 61/342,741, filed on Apr. 19, 2010.

(51) Int. Cl.

| | |
|---|---|
| ***A63B 21/00*** | (2006.01) |
| ***A63B 71/14*** | (2006.01) |
| *A63B 21/072* | (2006.01) |
| *A63B 69/06* | (2006.01) |
| *A63B 22/00* | (2006.01) |

(52) U.S. Cl.

CPC ..... *A63B 71/14* (2013.01); *A63B 21/0726* (2013.01); *A63B 21/0724* (2013.01); *A63B 69/06* (2013.01); *A63B 2022/0082* (2013.01)

USPC ..... 482/49; 482/104; 482/106; 482/107; 482/148

(58) Field of Classification Search

USPC ..... 482/49, 93, 104, 106, 108, 109

See application file for complete search history.

(56) References Cited

U.S. PATENT DOCUMENTS

| | | | | |
|---|---|---|---|---|
| 3,541,990 | A * | 11/1970 | Du Mas | 441/69 |
| 3,896,498 | A | 7/1975 | Pang | |
| 4,487,412 | A * | 12/1984 | Meeko | 482/139 |
| 4,754,499 | A | 7/1988 | Pirie | |
| 5,081,715 | A | 1/1992 | Mascia | |
| 5,118,100 | A * | 6/1992 | Sungaila | 482/105 |
| 5,173,963 | A | 12/1992 | Greenberg | |
| 5,704,845 | A * | 1/1998 | Boyte | 473/205 |
| 6,146,319 | A | 11/2000 | Tarail | |
| 6,849,036 | B2 * | 2/2005 | Forslid | 482/139 |
| 6,898,802 | B1 | 5/2005 | Suarkeo | |
| 7,004,889 | B2 | 2/2006 | McBride | |
| 7,736,284 | B1 | 6/2010 | Andrews | |
| 2003/0148861 | A1 | 8/2003 | McBride | |
| 2008/0120755 | A1 | 5/2008 | Ingram | |
| 2008/0125295 | A1 | 5/2008 | Ingram | |
| 2009/0275447 | A1 | 11/2009 | Fishman | |
| 2009/0275448 | A1 | 11/2009 | Fishman | |
| 2010/0043113 | A1 | 2/2010 | Clark | |
| 2010/0095421 | A1 | 4/2010 | Franklin | |
| 2010/0257652 | A1 | 10/2010 | Williams | |

* cited by examiner

*Primary Examiner* — Jerome W Donnelly
(74) *Attorney, Agent, or Firm* — White & Case LLP

(57) ABSTRACT

A bar grip used for grasping a bar or similarly shaped object for physical fitness such as a weightlifting bar, barbell, pull-up bar, or rowing paddle that requires significant grip force. The palm portion of the bar grip includes a palm surface for contacting a region of the palm, and a grip surface for contacting the fitness device. It may include at least one middle layer to provide additional padding, comfort, or weight distribution. The bar grip also has a strap portion for securing the palm portion to the hand. The palm portion has a cross-sectional C-shape that substantially matches an outer shape of a fitness bar. Different embodiments have different radii to accommodate differently sized or shaped fitness bars, or have built-in multi-radius options. The arc of the grip surface may vary to provide coverage ranging from minimal coverage to nearly complete coverage around the circumference of the bar.

18 Claims, 7 Drawing Sheets

BAR GRIP

CROSS-REFERENCE TO RELATED APPLICATION

This application claims the benefit of U.S. Provisional Application No. 61/342,741 entitled "PALM GRIP," filed Apr. 19, 2010. The subject matter of the related application is hereby incorporated by reference.

FIELD OF THE INVENTION

The invention generally relates to weight lifting and fitness exercise, and relates more particularly to a bar grip that is an easily donned and doffed gripping interface between a user's palm and an exercise bar.

BACKGROUND

Athletes and fitness enthusiasts commonly incorporate strength-building routines that use exercise equipment such as weight machines, barbells, dumbbells, bench press bars. Often, the apparatus between the user and the weight or forces used for fitness conditioning is a simple bar.

Traditional exercise bars are made of metal and have smooth portions of its surface that can slip in one's hand easily, and designated rough portions of the surfaces that are designed for increased friction, but are abrasive to a user's skin. The standard Olympic diameter of a workout bar is 2.80 centimeters (1.10 inches). Depending on the user and the particular exercise, considerable amounts of weight can be transmitted to a relatively small area of the palm.

When strength-building routines utilize significant weight and/or high repetitions, the intensity of the exercise creates conditions where the skin of the user's palms are subject to callusing. The process of callusing can be painful enough to reduce one's full capacity for physical training. Additionally, thick skin and the roughness of calloused hands are undesirable in most other areas of a person's functioning life.

Users commonly wear workout/weightlifting gloves to help evenly distribute the compressive forces over the anatomy of the hand and to avoid slipping and callusing problems. Workout gloves are somewhat cumbersome to put on and take off, even properly fitting ones. Workout gloves cover a significant portion of the hand and when gloves are worn continually, excessive body heat and sweating are common problems. Because gloves wrap around the base of all fingers and thumbs, and wrap around the hand, bunching material usually causes uncomfortable constrictions and uneven areas of pressure.

Calluses built from these strength-building routines most commonly form on a narrow region of the hand predominantly comprising the strip of palm just below the fingers, and on the first pads of the fingers closest to the palm.

SUMMARY

In one embodiment, a bar grip is configured to grasp a bar or similarly shaped object used in a physical fitness environment such as a weightlifting bar, barbell, pull-up bar, or rowing paddle where significant grip force is required. The bar grip includes a palm portion having a palm surface for contacting a region of the palm of the hand and a grip surface for contacting a physical fitness device. The palm portion may include at least one layer disposed between the palm surface and the grip surface for additional padding, comfort, or weight distribution. The palm surface and the grip surface may be opposite sides of a common layer of material. The bar grip may include a strap portion configured to extend around the back of the hand to provide a means to secure the palm portion to the hand. The strap portion may be an adjustable closed loop configured to extend around the back of the hand or a semi-rigid open loop configured to cradle both sides of the hand. Each disclosed embodiment allows for variable positioning of the bar grip on the hand to provide customized protection for a wide variety of exercises that require the gripping force of a hand. Some or all of the palm portion or strap portion may be constructed from positively buoyant material for floatation in water sports.

The grip surface is contoured in a C-shape to substantially match the outer shape of a cylindrically shaped bar, which can be circular, elliptic, parabolic or hyperbolic. Various embodiments of the palm portion have various cross-sectional shapes to accommodate differently shaped or sized fitness bars. An alternative embodiment has built-in multi radius options. For example, in one embodiment the palm portion is configured to flex under pressure of a gripping hand to conform around the outer surface of a bar. The arc of the grip surface on various embodiments of the bar grip may vary to provide coverage ranging from minimal coverage to nearly complete coverage around the circumference of the bar in order to suit the demands of various fitness training styles and hand protection needs. The cross-sectional thickness of the palm portion of the bar grip may vary between different embodiments of the bar grip to allow extra padding or to optimize force distribution and comfort to the hand. The cross-section of the palm portion forms a C-shape or crescent shape.

BRIEF DESCRIPTION OF THE DRAWINGS

The advantages and characteristic features of the bar grip summarized above are outlined in the Detailed Description of the Drawings below. For clarity, the following figures will be referred to throughout the detailed description.

DETAILED DESCRIPTION OF THE DRAWINGS

By simultaneously focusing specifically on the narrow regions of the palm needing the most protection, and by introducing the option of variable positioning of a bar grip on the hand, and by considering and accommodating for the shape of a workout bar, the bar grip outlined here provides an optimized solution to the problem of hand protection while working out.

Figure 1:
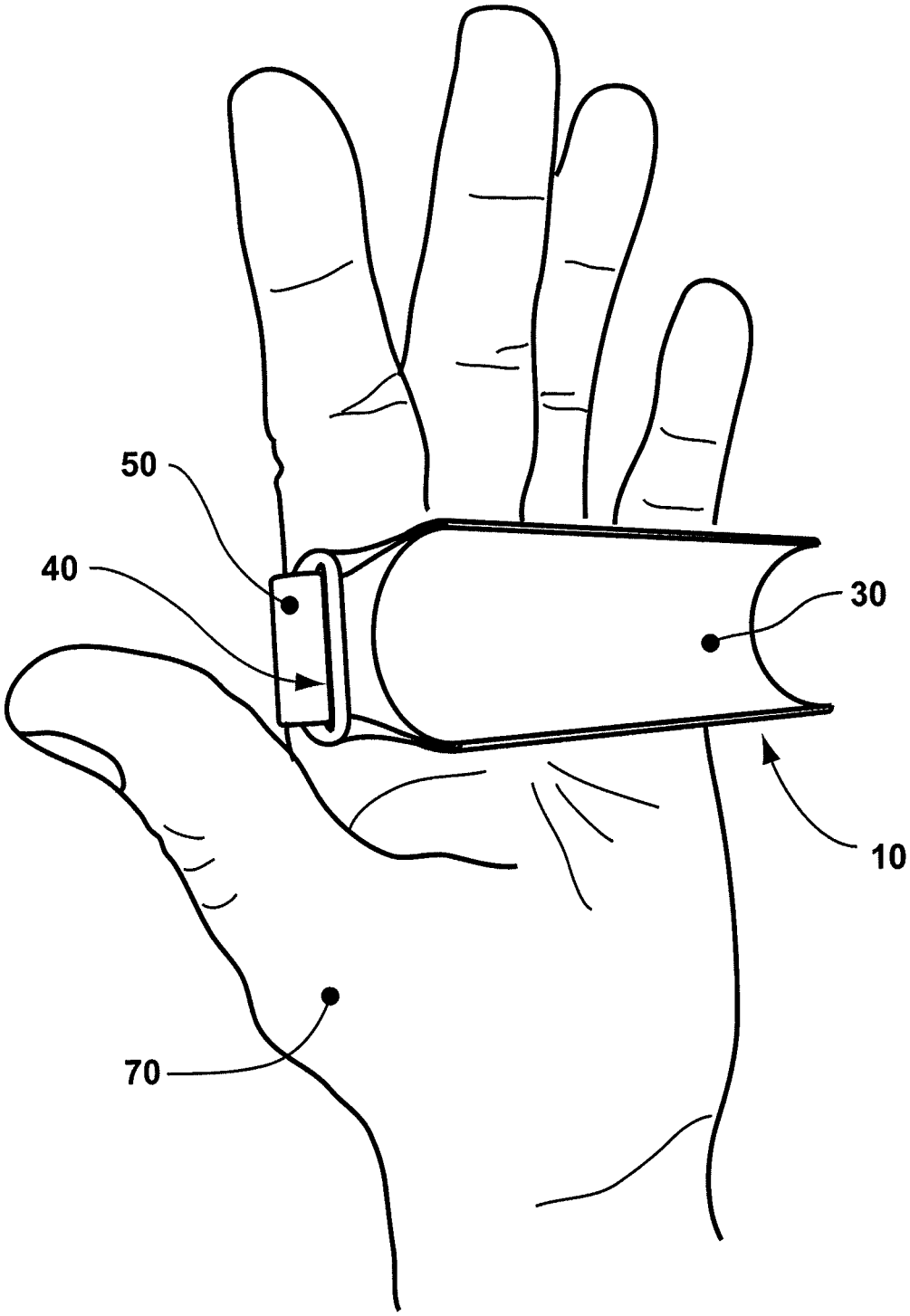
FIG. 1 is a perspective view of one embodiment of the bar grip positioned on a hand.

In FIGS. 1, 4, 5, 6, and 7, a bar grip 10 is worn on a hand 70 of an individual. Bar grip 10 may be worn on the left or right hand, but may be designed with symmetric differences to better fit a left hand or a right hand accordingly. Bar grip 10 includes a palm portion 15 and a strap portion 50. In general, palm portion 15, which in FIG. 1 is shown lying adjacent to the palm of hand 70, covers only the specific region of the palm requiring protection during a given exercise. Most hand controlled exercises negatively impact only a narrow region of the palm. Bar grip 10 may be positioned by the user to protect a specific region of the palm depending on the various workout exercises being engaged in.

Figure 4:
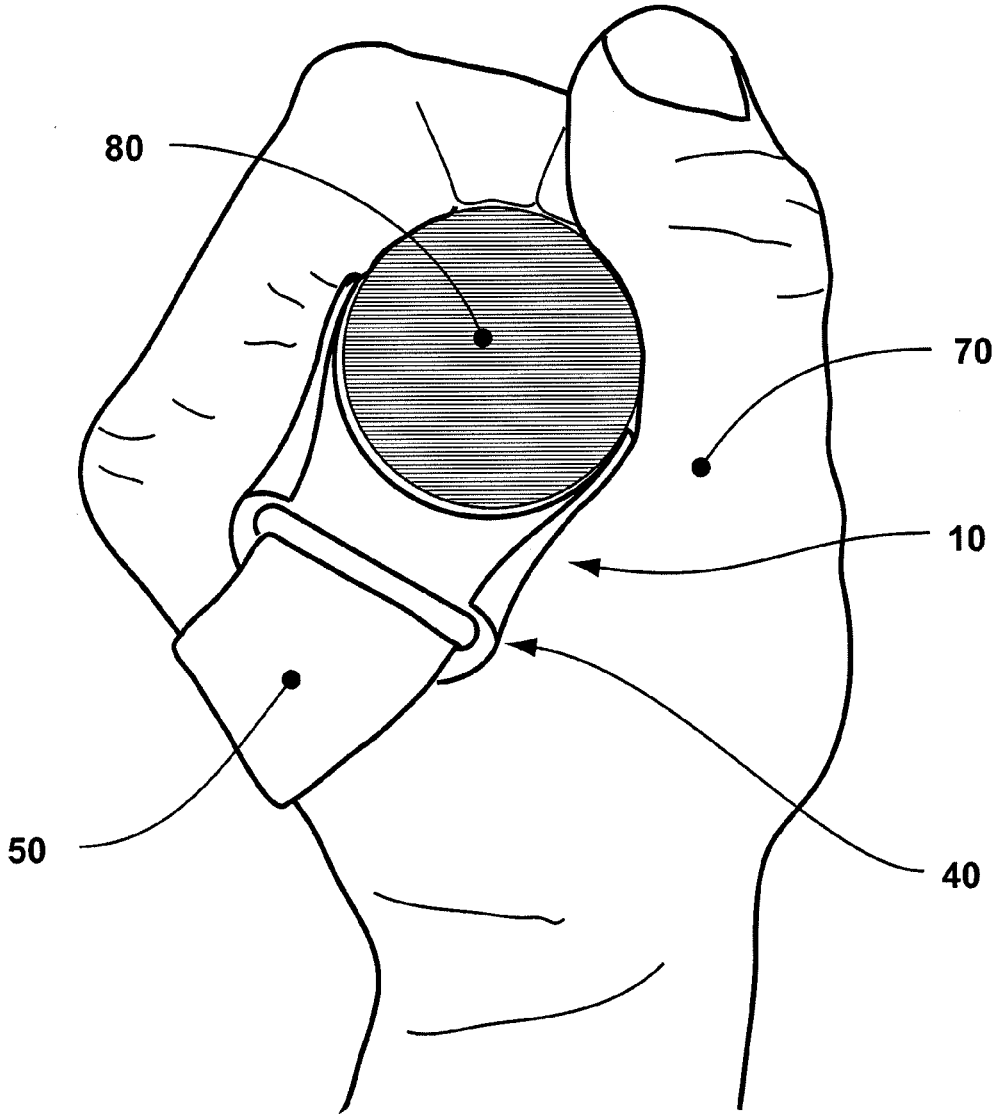
FIG. 4 shows a side view of one embodiment of a bar grip and a hand gripping a workout bar in a position typical of a bench press exercise.
Figure 5:
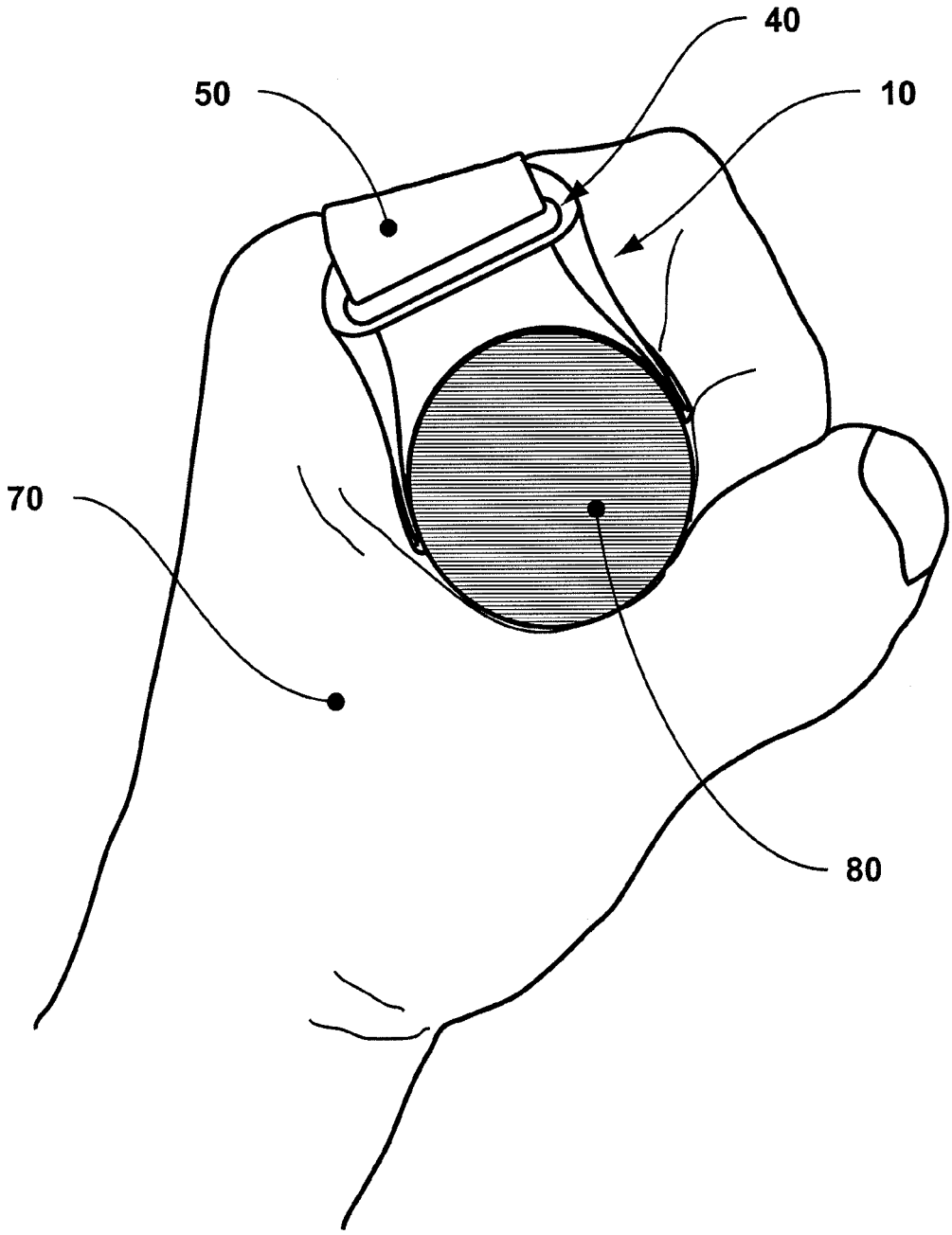
FIG. 5 shows a side view of one embodiment of a bar grip and a hand gripping a workout bar in a position typical of a pull-up exercise.

Referring to FIGS. 4 and 5, hand 70 is utilizing bar grip 10 to assist in gripping a bar 80, for example an Olympic weight-lifting bar that is 28 mm in diameter. Bar 80 may also be connected to a weight machine, dumbbell, barbell, or other similarly used objects or exercise equipment.

Palm portion 15 extends between hand 70 and bar 80. A grip surface 30 of palm portion 15 is C-shaped to substantially match the outer shape of bar 80 allowing for easy and secure contact and positioning of hand 70 in the various exercise options. An alternative embodiment has built-in multi radius options. For example, in one embodiment, palm portion 15 is configured to flex under pressure of a gripping hand to conform around the outer surface of a bar.

Figure 6:
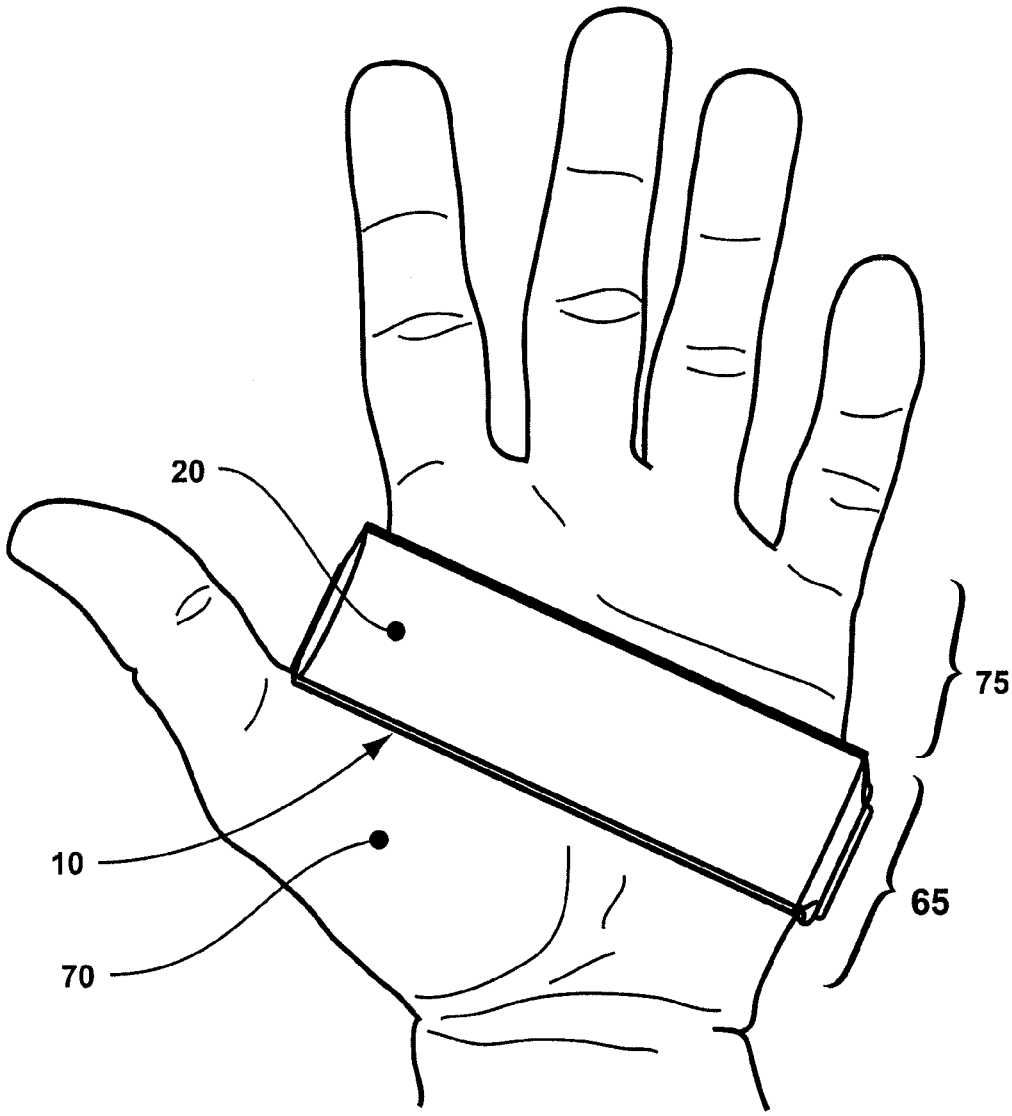
FIG. 6 shows one embodiment of a bar grip positioned on an open hand in preparation for a bench press type of exercise.
Figure 7:
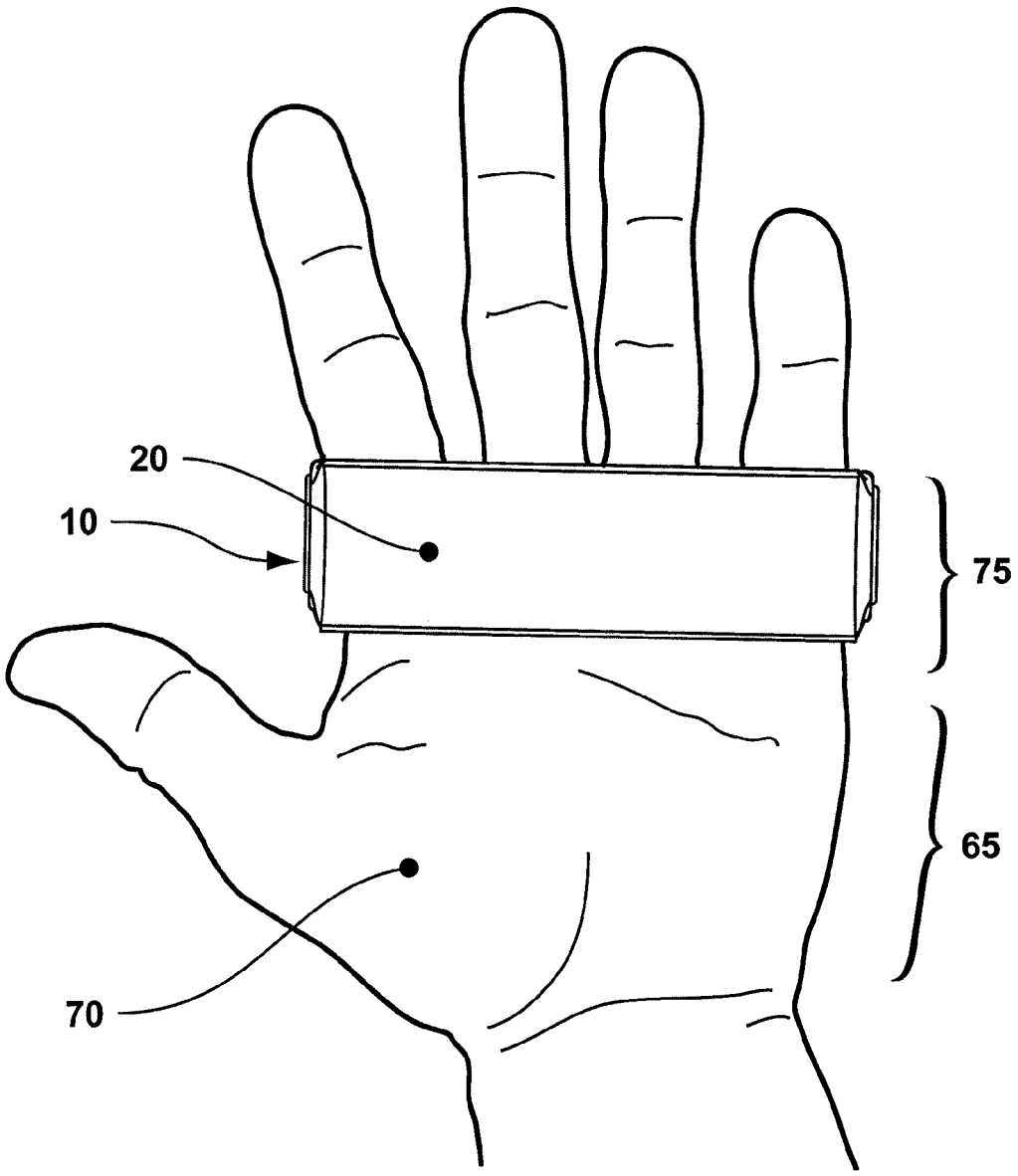
FIG. 7 shows one embodiment of a bar grip positioned on an open hand in preparation for a pull-up type of exercise.

FIGS. 4, 5, 6, and 7 show two examples of bar grip 10 placements to accommodate two common exercise positions. In FIGS. 4 and 6, bar grip 10 provides protection to hand 70 on a lower region 65 of the palm as would be used in a bench pressing type of exercise. Strap portion 50, in this position, extends around the dorsal side of hand 70 securing bar grip 10 in the desired position. FIGS. 5 and 7 show bar grip 10 positioned to protect an upper region 75 of the palm encompassing base sections of the fingers as would be used in a pull-up type of exercise. Strap portion 50 in this position extends over the first set of knuckles or around the proximal phalanges, securing bar grip 10 in this particular position.

Figure 2:
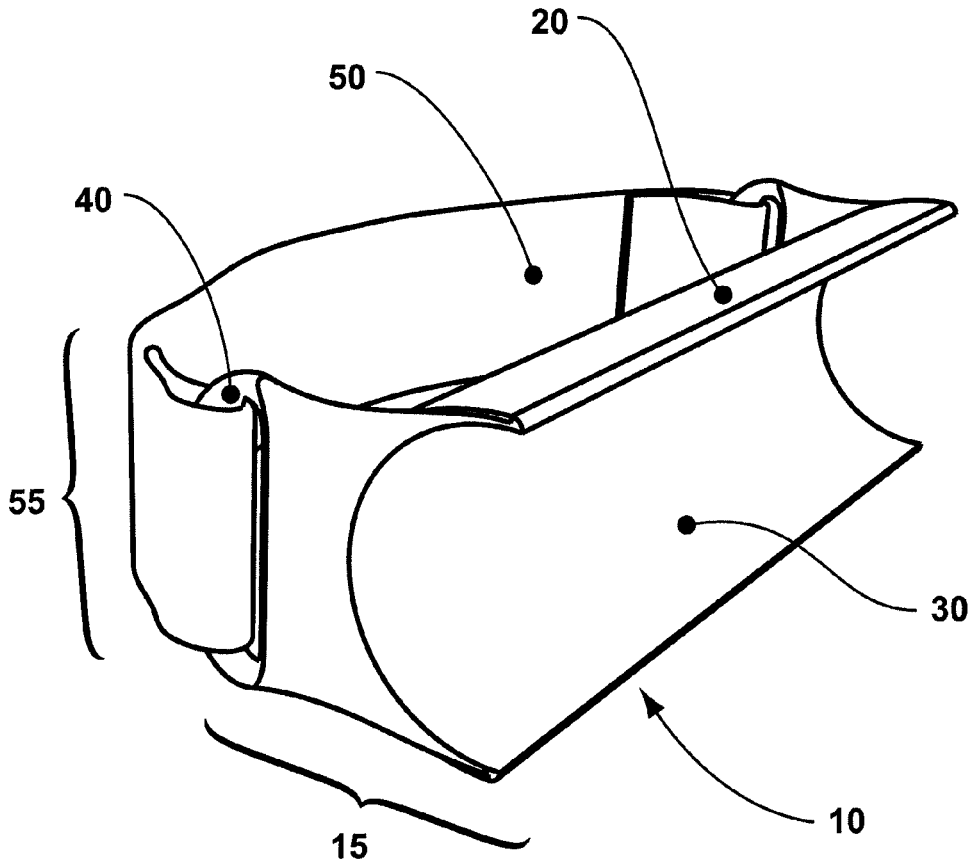
FIG. 2 shows one embodiment of the bar grip in perspective view.

Referring to FIG. 2, strap portion 50 extends from both ends of palm portion 15 across a palm surface 20 of bar grip 10. Strap portion 50 may be made of a durable elastic material or a sturdy webbing type of material. In the FIG. 2 embodiment, each end of palm portion 15 includes an eye 40 that strap portion 50 is fastened to. Considering that bar 80 has a cylindrical outer shape in this embodiment, the cross-sectional shape of grip surface 30 of palm portion 15 is substantially the same as the cross-sectional shape of bar 80. Likewise, the axis extending through the cross-sectional center of grip surface 30 of palm portion 15 substantially coextends with the axis of bar 80. Eyes 40 may be fashioned so each of them can be shifted or rotated about the axis of palm portion 15, and thus also bar 80, allowing strap portion 50 to extend around the back of hand 70 in a slightly offset or diagonal configuration which may provide better bar grip 10 usability, comfort, and positioning on hand 70. In another embodiment, strap portion 50 may be an extension of any of the layers of material making up palm portion 15, or connect directly to palm portion 15.

Figure 3:
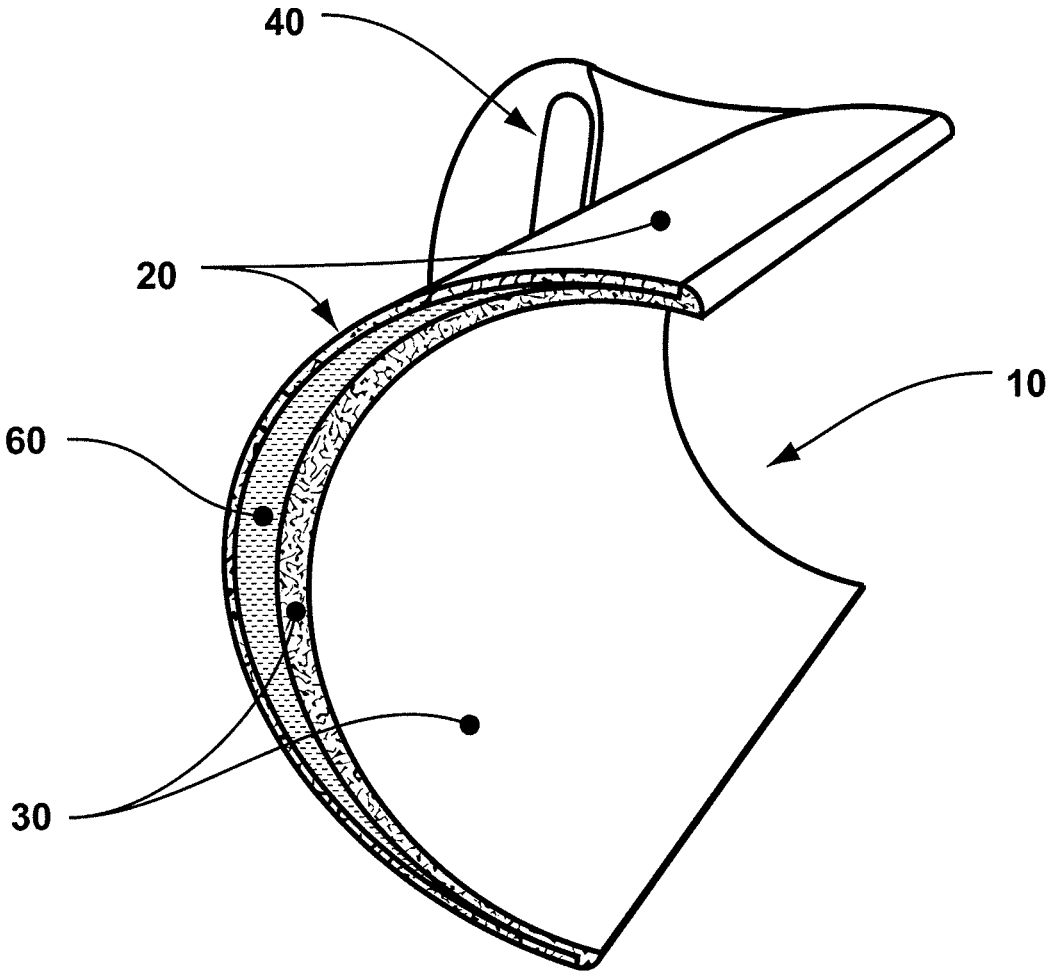
FIG. 3 shows a cross-sectional view of one embodiment of a bar grip.

Referring to FIG. 3, the cross-sectional view of grip surface 30 is shown to be contoured in a C-shape to fit the outer shape of bar 80. In this embodiment, grip surface 30 covers approximately half of the circumference of the outer surface of bar 80. In other embodiments of bar grip 10, the arc of grip surface 30 varies to provide coverage ranging from minimal coverage to nearly complete coverage around the circumference of bar 80 in order to suit the demands of various fitness training styles and hand protection needs. The FIG. 3 embodiment also shows a middle layer 60 disposed between palm surface 20 and grip surface 30 for additional padding, comfort, or weight distribution. Palm surface 20, grip surface 30, and middle layer 60 of different embodiments have different thickness, texture, and hardness. The cross-sectional construction and thickness of palm portion 15 in various embodiments is different to allow more or less padding, or to optimize force distribution and comfort to hand 70.

In one embodiment, some or all of palm portion 15 or strap portion 50 is constructed from positively buoyant material for flotation in water sports.

To remove bar grip 10 from hand 70, the user simply extracts hand 70 from the region between palm portion 15 and strap portion 50.

bar grip 10 has many benefits. The reduction in material required for hand protection allows for a product that does not prevent hand 70 from naturally cooling during exercise, which subsequently reduces the undesirable moisture build-up from sweat. In addition, the reduced material from the optimized design minimizes the possibility for material to bunch while in compression during exercising. Such bunching of material causes uneven pressure points and sheer forces on hand 70 which reduces comfort and contributes to callusing of hand 70. Extra material can also be cumbersome both visually and functionally. Bar grip 10 looks refined and sleek. The small volume of material used makes bar grip 10 compact and light which makes it easy to wear and easy to carry and pack away for transportation. Putting on, positioning, and taking off bar grip 10 is simple, straightforward, quick, and easy. Bar grip 10 provides focused protection where protection is needed and leaves the rest of hand 70 exposed to contact the exercise equipment. Increasing direct contact allows for greater interaction with and sensitivity to the exercise equipment which results in greater control during the exercise process. Bar grip 10 provides an opportunity to protect the most negatively impacted area of hand 70 while maintaining a significant amount of direct interaction and control.

The invention has been described above with reference to specific embodiments. It will, however, be evident that various modifications and changes may be made thereto without departing from the broader spirit and scope of the invention as set forth in the appended claims. The foregoing description and drawings are, accordingly, to be regarded in an illustrative rather than a restrictive sense.

What is claimed is:

1. A bar grip, comprising:

a palm portion having a palm surface and a grip surface, the grip surface having a cross-sectional C-shape, wherein the palm surface is formed of a first layer of material and the grip surface is formed of a second layer of material, and at least one third layer disposed between the palm surface and the grip surface, wherein the palm portion is configured to conform around an outer shape of a bar under pressure of a gripping hand; and a strap portion configured to span the dorsal side of a hand at a position substantially opposite to the position of the palm surface when the palm surface is in contact with the palm of the hand.

2. The bar grip of claim 1, wherein the at least one third layer disposed between the palm surface and the grip surface extends beyond the proximal and distal ends of the palm surface and the grip surface to form the strap portion.

3. The bar grip of claim 1, wherein the strap portion and the at least one third layer between the palm surface and the grip surface form a unitary layer of material.

4. The bar grip of claim 1, wherein the palm surface is made of a different material than that of the grip surface.

5. The bar grip of claim 1, wherein the cross-sectional C-shape of the grip surface is substantially cylindrical.

6. The bar grip of claim 1, wherein the cross-sectional C-shape of the grip surface is substantially circular cylindrical.

7. The bar grip of claim 1, wherein the cross-sectional C-shape of the grip surface is substantially elliptic cylindrical.

8. The bar grip of claim 1, wherein the cross-sectional C-shape of the grip surface is substantially parabolic cylindrical.

9. The bar grip of claim 1, wherein the cross-sectional C-shape of the grip surface is substantially hyperbolic cylindrical.

10. The bar grip of claim 1, wherein the strap portion has one end coupled to a distal end of the palm portion and another end coupled to a proximal end of the palm portion.

11. The bar grip of claim 1, wherein the strap portion has one end coupled to a distal end of the palm portion and another end being removably coupled to a proximal end of the palm portion.

12. A bar grip, comprising:

a palm portion having a palm surface and a grip surface, the grip surface having a cross-sectional C-shape;

a strap portion configured to secure the palm portion to a hand by spanning a dorsal side of the hand at a position substantially opposite to the position of the palm surface when the palm surface is in contact with the palm of the hand; and a first rotating end formed at a distal end of the palm portion, wherein the first rotating end rotates around the distal end of the palm portion at an angle relative to a cross-sectional center of the palm portion, wherein the strap portion is coupled to the first rotating end.

13. The bar grip of claim 12, further comprising:

a second rotating end formed at a proximal end of the palm portion, wherein the second rotating end rotates around the proximal end of the palm portion at an angle relative to the cross-sectional center of the palm portion;

wherein the strap portion is coupled to both the first rotating end and the second rotating end.

14. A bar grip comprising:

a palm portion having a palm surface and a grip surface, the grip surface having a cross-sectional C-shape;

a strap portion configured to secure the palm portion to a hand by spanning a dorsal side of the hand at a position substantially opposite to the position of the palm surface when the palm surface is in contact with the palm of the hand; and an opening formed at a distal end of the palm portion, wherein the strap portion is coupled to the opening.

15. The bar grip of claim 14, further comprising:

a second opening formed at a proximal end of the palm portion, wherein the strap portion is further coupled to the second opening.

16. The bar grip of claim 12, wherein the palm portion is configured to flex under pressure of a gripping hand to conform around the outer shape of a bar.

17. A bar grip, comprising:

a palm portion including:

a grip surface having a cross-sectional C-shape; and a palm surface configured to lie adjacent to a palm of a hand and to cover a specific region of the hand requiring protection, wherein the specific region is not an entirety of a palm; and a strap portion configured to span the dorsal side of a hand at a position substantially opposite to the position of the palm surface when the palm surface is in contact with the palm of the hand, wherein the strap portion is formed of a layer disposed between the palm surface and the grip surface that extends beyond the proximal and distal ends of the palm surface and the grip surface.

18. The bar grip of claim 17, wherein the palm portion is configured to conform around the outer shape of a bar under pressure of a gripping hand.

* * * * *